United States Patent [19]

Ishii et al.

[11] Patent Number: 4,856,470

[45] Date of Patent: Aug. 15, 1989

[54] ENGINE WORKING MACHINE ASSEMBLY WITH SOUNDPROOF COVER

[75] Inventors: Akira Ishii; Ryoichi Ito, both of Osaka, Japan

[73] Assignee: Kubota Ltd., Osaka, Japan

[21] Appl. No.: 275,563

[22] Filed: Nov. 23, 1988

[30] Foreign Application Priority Data

Dec. 2, 1987 [JP] Japan ..... 62-306251

[51] Int. Cl.[4] ..... F02B 77/00

[52] U.S. Cl. ..... 123/195 C; 290/1 B

[58] Field of Search ..... 123/195 C, 198 E; 290/1 A, 1 B, 2

[56] References Cited

U.S. PATENT DOCUMENTS

| | | | |
|---|---|---|---|
| 1,608,286 | 11/1926 | Andrews et al. | 290/1 B |
| 2,543,541 | 2/1951 | Angle . | |
| 4,459,944 | 7/1984 | Kirchweger et al. | 123/41.66 |
| 4,540,888 | 9/1985 | Drewry et al. | 290/1 R |
| 4,608,946 | 9/1986 | Tanaka et al. | 123/41.65 |
| 4,622,923 | 11/1986 | Nishimura et al. | 123/41.65 |
| 4,647,835 | 3/1987 | Fujikawa et al. | 290/1 B |
| 4,677,940 | 7/1987 | Bracht et al. | 290/1 A |
| 4,779,905 | 10/1988 | Ito et al. | 123/2 |

FOREIGN PATENT DOCUMENTS

| | | | |
|---|---|---|---|
| 0005346 | 1/1978 | Japan | 290/1 B |
| 0197417 | 11/1983 | Japan | 290/1 A |

*Primary Examiner*—David A. Okonsky

*Attorney, Agent, or Firm*—Lowe, Price, LeBlanc, Becker & Shur

[57] ABSTRACT

In an engine working machine assembly with a soundproof cover, the soundproof cover is provided for the engine working machine assembly in which a working machine such as a generator, a compressor and the like is adapted to be driven by an internal combustion engine, the working machine and a cooling fan are arranged in order upward above the vertical shaft type air-cooled engine as the internal combustion engine, and a fan case is fixedly secured at its lower wall portion to the engine through a cooling air guide cover for the working machine and a cooling air guide cover for the engine. The soundproof cover comprises an upper side cover section, a front side cover section and a back side cover section. And the upper side cover section is detachably fixed to the fan case at its lower wall portion, at least one of the front side cover section and the back side cover section is detachably fixed to the upper side cover section, and the other cover section is detachably fixed to said one cover section by means of fixing means.

6 Claims, 6 Drawing Sheets

ENGINE WORKING MACHINE ASSEMBLY WITH SOUNDPROOF COVER

BACKGROUND OF THE INVENTION

1. Field of the Invention

The present invention relates to an engine working machine assembly with a soundproof cover, in which a soundproof cover is provided for an engine working machine assembly having a working machine such as a generator and a compressor which is adapted to be driven by an internal combustion engine, and particularly to an engine working machine assembly with a soundproof cover in which a vertical shaft type air-cooled engine is employed as an internal combustion engine.

2. Prior Art

As such an engine working machine assembly with a soundproof cover, has been conventionally known the one disclosed in U.S. Pat. No. 2,543,541 (Patented Feb. 27, 1951). In this conventional embodiment, a generator (a working machine) and a cooling fan are arranged in series above an air-cooled vertical shaft type engine so as to be interlockingly connected with the engine, and these engine, generator and cooling fan are enclosed with a soundproof cover. The soundproof cover comprises three cover sections, that is, an upper side cover section which encloses the cooling fan, an inner peripheral cover section and an outer peripheral cover section both of which are arranged coaxially so as to enclose the lateral peripheries of the engine and the generator, and it is fixedly secured to the engine working machine assembly in a following way.

The upper side cover section is adapted to be detachably fixed to a fixing bracket attached to the housing of the generator, And the inner peripheral cover section is adapted to be detachably fixed at its lower peripheral edge as well as its upper peripheral edge to the engine base as well as to the upper side cover section respectively. Further, the outer peripheral cover section is adapted to be detachably fixed at its lower peripheral edge as well as its upper peripheral edge to the engine base as well as to the upper side cover section.

However, there are following problems associated with the soundproof cover having the above-mentioned construction.

(a) It is difficult to perform a maintenance of the engine.

When performing a maintenance of a certain portion of the engine, the lateral space for the engine gets accessible by dismounting the soundproof cover in a following procedure. First of all, the outer peripheral cover section shall be dismounted from the upper side cover section and the engine base. Then, the inner peripheral cover section shall be detached at its lower peripheral edge from the engine base. Lastly, the upper side cover section shall be dismounted from the fixing bracket with the inner peripheral cover section connected therewith.

In this way, since all the three cover sections should be dismounted in order to perform the maintenance of a certain portion of the engine, it takes much labor to dismount them as well as it is difficult to perform the maintenance.

(b) The construction for mounting the upper side cover section is complicated.

Since it is necessary to provide the fixing bracket used only for detachably fixing the upper side cover section to the engine working machine assembly, the number of the component parts becomes large and the construction for mounting the upper side cover section becomes complicated.

SUMMARY OF THE INVENTION

It is an object of the present invention to make it easy to perform a maintenance of an engine in an engine working machine assembly with a soundproof cover.

It is another object of the present invention to simplify the construction for mounting an upper side cover therein.

For accomplishing these objects, an engine working machine assembly with a soundproof cover according to the present invention is constructed as follows.

That is, above a vertical shaft type engine, there are arranged a working machine and a cooling fan in order upward, a cooling air guide cover for the engine which encloses the outer periphery of the engine and a cooling air guide cover for the working machine which encloses the outer periphery of the working machine are fixedly secured to the engine, and a fan case which encloses the cooling fan is fixedly secured at its lower wall portion to the cooling air guide cover for the working machine. A soundproof cover comprises a upper side cover section, a front side cover section and a back side cover section. And the upper side cover section is detachably fixed to the lower wall portion of the fan case by a fixing means. At least one of the front side cover section and the back side cover section is detachably fixed to the upper side cover section by a fixing means. Further said one cover section is detachably fixed to the other cover section by a fixing means.

Since the present invention is constructed as mentioned above, following advantages can be attained.

(a) The maintenance of the engine can be performed easily. At the time of the maintenance of the engine, the soundproof cover is dismounted, for example according to the following procedure. In case that a part for which a maintenance is required is enclosed by the other cover section, it is enough only to dismount the other cover section from the one cover section. And in case that a part for which a maintenance is required is enclosed by the one cover section, firstly the other cover section shall be dismounted from the one cover section and then the other cover section shall be dismounted from the upper side cover section.

In this way, in order to access the part for which the maintenance is required in the engine, it is enough to dismount at least one of the cover sections. Since it is not necessary to dismount the upper side cover section, it doesn't take much labor for dismounting the soundproof cover and the maintenance can be performed easily.

(b) The construction for mounting the upper side cover section becomes simplified.

The upper side cover section is fixedly secured to the engine through the lower wall portion of the fan case, the air guide cover for the working machine and the air guide cover for the engine. Therefore, since it becomes unnecessary to provide a fixing bracket for mounting the upper side cover section differently from the conventional construction, the construction for mounting the upper side cover is simplified.

(c) The manufacturing cost of the soundproof cover gets reduced.

Since the cover section which encloses the lateral periphery of the engine working machine is divided into two sections, namely into its front side cover section and its back side cover section, a rapping construction of a mold becomes simplified as well as a mold becomes small in size in the case that the soundproof cover is made of a synthetic resin by means of an injection molding. Therefore, the manufacturing costs of the mold as well as the soundproof cover get reduced.

(d) In the above-mentioned construction of the soundproof cover, a vibration of the soundproof cover is restrained and a noise generated by the engine working machine assembly gets reduced in the case that the one cover section and the other cover section are fixedly secured to the engine or the steady rests thereof are provided.

(e) Further, in the case that a handy handle for carrying the engine working machine assembly is arranged so as to be accommodated in a concaved portion provided in the upper side cover section in the above-mentioned construction of the soundproof cover, the handy handle doesn't project outside the soundproof cover and hence the total height of the engine working machine assembly gets lowered.

Other and additional objects and advantages will become apparent to those skilled in the art as the description proceeds in connection with the accompanying drawings, wherein:

BRIEF DESCRIPTION OF THE DRAWINGS

FIGS. 1 through 6 show an embodiment thereof;

FIG. 1 is a vertical sectional front view of a portable engine generator as an engine working machine assembly;

FIG. 2 is a front view of the engine generator;

FIG. 3 is a partially sectional left side view of the engine generator;

FIG. 4 is a section view on IV—IV directed bent line in FIG. 1;

FIG. 5 is a sectional view on V—V directed line in FIG. 1;

FIG. 6 is a schematic perspective view showing an exploded state of the engine generator; and FIG. 7 is a view showing the other embodiment of the present invention corresponding to FIG. 6.

DESCRIPTION OF THE PREFERRED EMBODIMENT

Now one embodiment in which the present invention is applied to a portable engine generator will be explained with reference to the drawings hereinafter.

Figure 1:
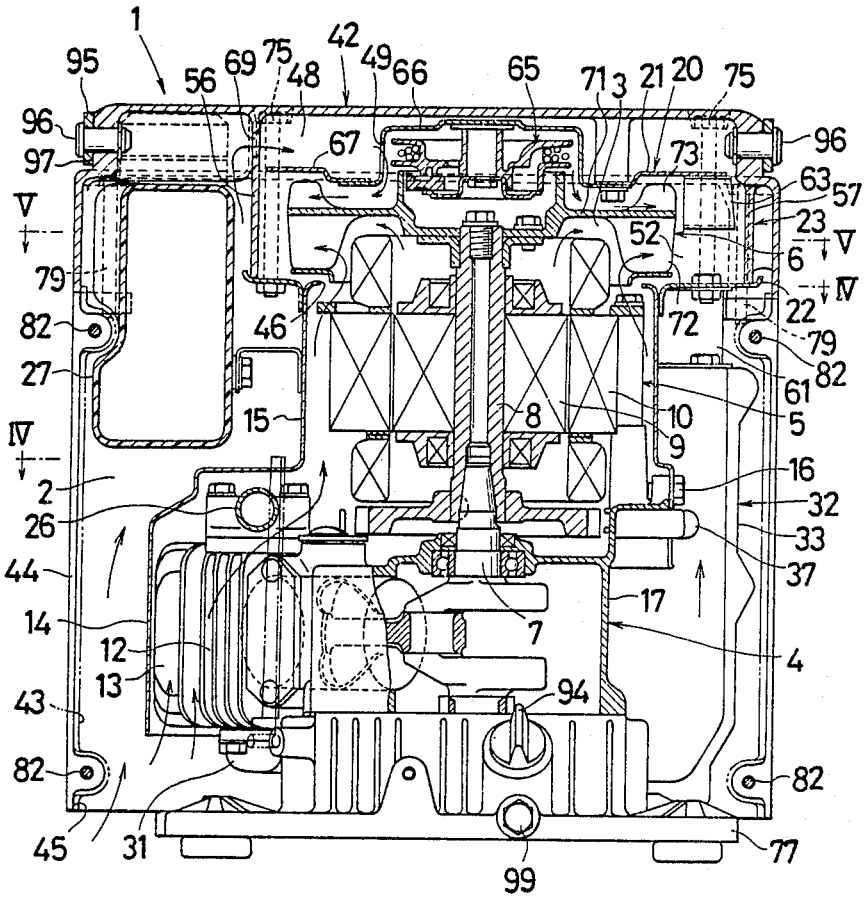
FIGS. 1 through 7 show the embodiments of the present invention.

As shown in FIG. 1, an interior space of a soundproof cover 1 of an engine generator is partitioned to a machine room 2 at the lower side thereof 1 and to a fan room 3 at the upper side thereof 1. A vertical shaft type air-cooled engine 4 is disposed in the lower portion of the machine room 2, and a generator (a working machine) 5 is disposed above the engine 4. And a centrifugal cooling fan 6 is disposed in the fan room 3. And these generator 5 and cooling fan 6 are connected interlockingly with the engine 4. That is, the rotation shaft 8 of the generator 5 is fixedly secured to the upper portion of the crank shaft 7 of the engine 4, and the stator 10 thereof 5 is fixedly mounted so as to encircle the rotor 9 fixedly secured to the rotation shaft 8. Further, the cooling fan 6 is fixedly secured to the upper end portion of the rotation shaft 8.

The outer periphery of the cylinder 12 and the cylinder head 13 of the engine 4 is covered by a cooling air guide cover 14 for the engine 4, and the outer periphery of the generator 5 is covered by a cooling air guide cover 15 for the generator 5. These cooling air guide covers 14, 15 are formed integrally and fixedly secured to the crankcase 17 of the engine 4 by means of a plurality of bolts 16 as well as to the cylinder head 13 by means of a plurality of nuts 18 (refer to FIG. 4). The cooling fan 6 is covered by a fan case 20 which partitions the fan room 3. The fan case 20 comprises an upper wall portion 21, a lower wall portion 22 and a peripheral wall portion 23 and is fixedly secured at its lower wall portion 22 to the cooling air guide cover 15 for the generator 5.

In an exterior space outside the cooling air guide covers 14, 15 within the machine room 2, there are arranged following various kinds of devices and so on.

Figure 2:
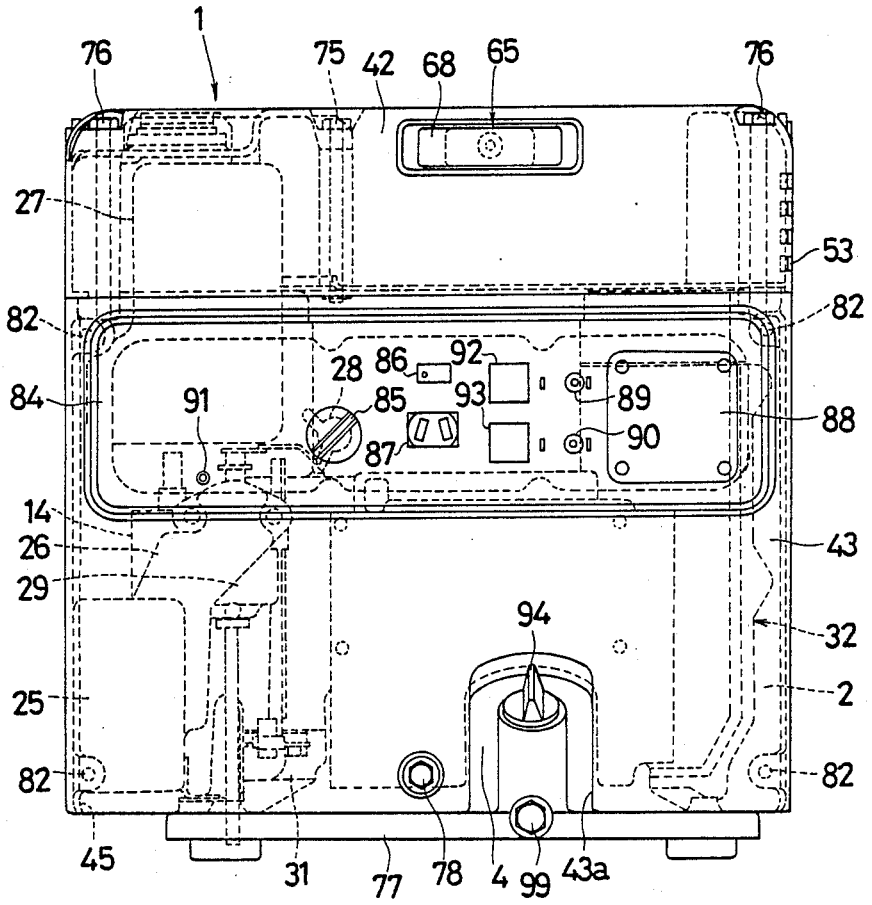
Figure 4:
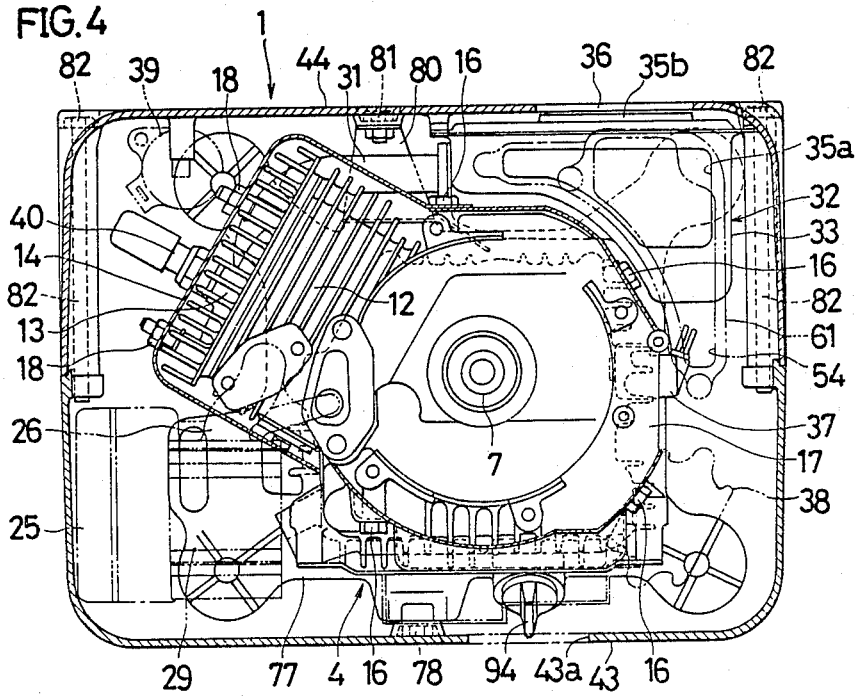

That is, as shown in FIG. 2 and FIG. 4, at the left side of the cooling air guide cover 14 for the engine 4, there are arranged an intake device equipped with an air cleaner 25 and an intake pipe 26 as well as a fuel supply system equipped with a fuel tank 27, a fuel cock 28 and a carburetor 29.

Figure 5:
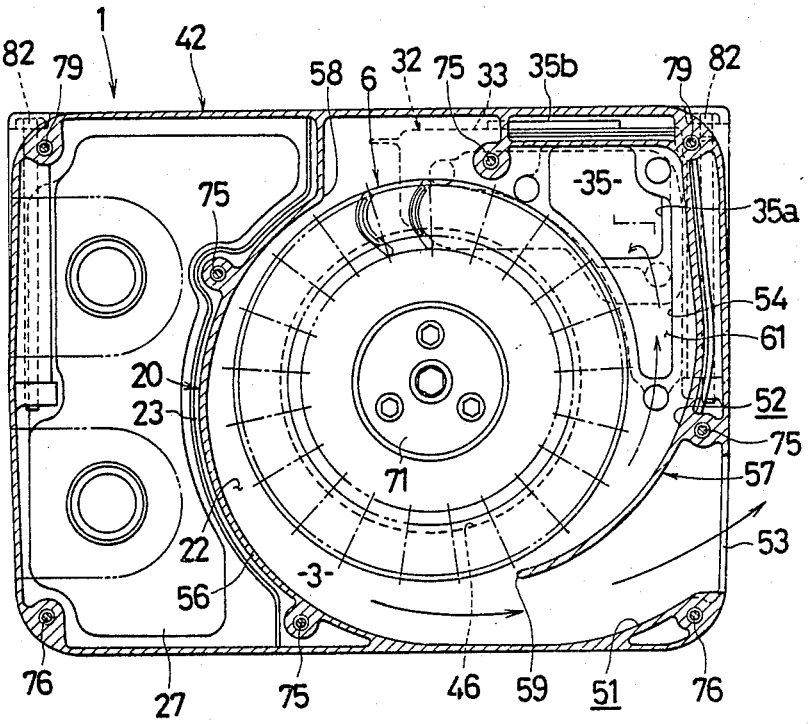

And as shown in FIG. 4 and FIG. 5, an exhaust pipe 31 and a muffler unit 32 are disposed at the back side of the cooling air guide cover 15 for the generator 5. The muffler unit 32 comprises a muffler cover 33 and an exhaust muffler 34 which is accommodated therewithin 33 through a muffler cooling air passage 35. The inlet **35*a* of the muffler cooling air passage 35 is opened in the upper portion of the muffler cover 33 and the outlet 35*b* thereof 35 is opened in the back and lower portion of the muffler cover 33. And the exhaust gas outlet of the exhaust muffler 34 is opened inside of the outlet 35*b* of the muffler cooling air passage 35. A discharge outlet 36 is provided in the casing 1 corresponding to the positions of the outlet 35*b* of the muffler cooling air passage 35** and the exhaust gas outlet.

Further, as shown in FIG. 4, around the periphery of the cooling air guide cover 14 for the engine 4, there is provided a spark-ignition system equipped with a rotary sensor 37, a capacitor-discharge type ignition device (a DCI device) 38, an ignition coil 39, an ignition plug 40 and so on.

Figure 6:
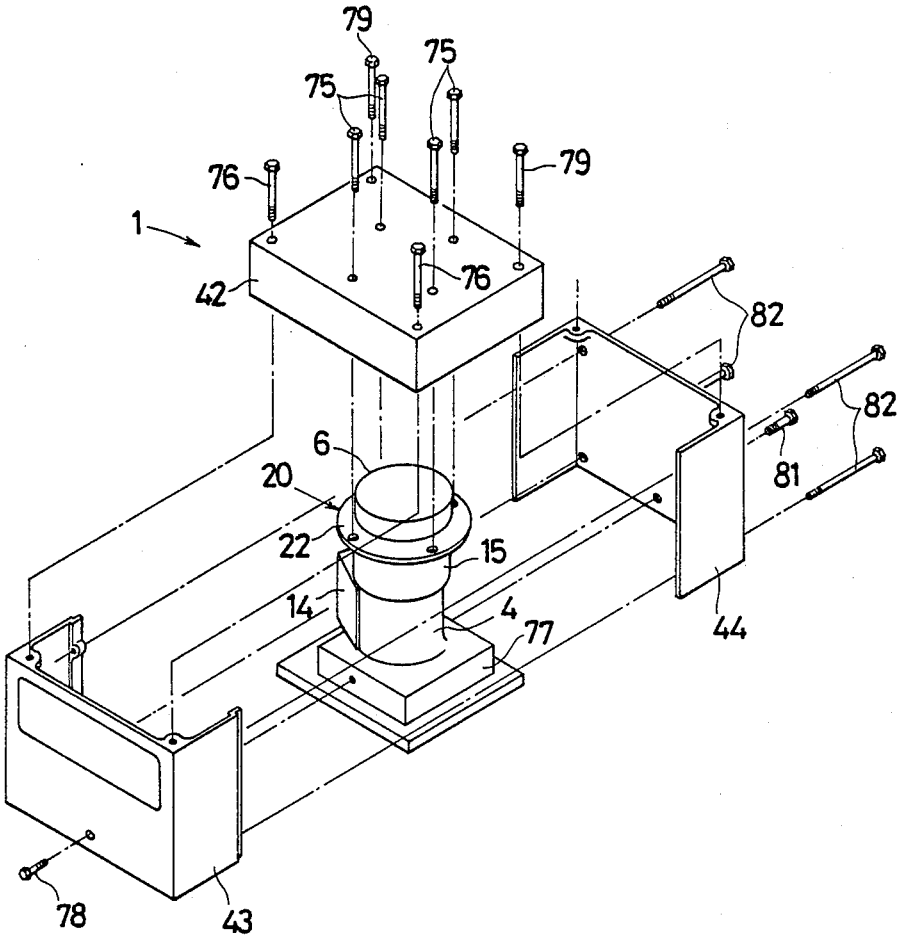

The above-mentioned soundproof cover 1 made of a synthetic resin is as whole formed in a rectangular parallelepiped configuration having an opened bottom, and as shown in FIG. 6, it comprises an upper side cover section 42 for covering the upper portion of the engine generator, a front side cover section 43 for covering the front half portion of the lateral periphery thereof, a back side cover section 44 for covering the back half portion of the lateral periphery thereof.

And as shown in FIG. 1, a ventilation inlet 45 is provided for the machine room 2 by the opened bottom of the soundproof cover 1, and an air suction opening 46 is provided for the fan room 3 by opening the upper side of the cooling air guide cover 15 for the generator 5 so as to face the machine room 2. Accordingly, the lower space within the cover 1 is in communication with the exterior space outside the cover 1 through the interior spaces within the cooling air guide cover 14 for the engine 4 as well as the cooling air guide cover 15 for the generator 5 and the fan room 3 in order. Further as shown in FIG. 5, an exhaust air outlet passage 51 and an exhaust air conduction passage 52 are formed in such a manner as to come out of the periphery of the fan room 3 in parallel within the fan case 20. The outlet 53 of the exhaust air outlet passage 51 is in communication with the atmosphere as well as the outlet 54 of the exhaust air conduction passage 52 is in communication with the muffler cooling air passage 35 within the muffler cover 33.

The constructions of the fan case 20 and the cooling fan 6 will be explained more concretely with reference to FIG. 1 and FIG. 5.

As shown in FIG. 5, the peripheral wall portion 23 of the fan case 20 is formed integrally with the upper side cover section 42 inside thereof 42. The peripheral wall portion 23 is provided with a first cooling air guide wall 56 at the left side thereof 23 and with a second cooling air guide wall 57 at the right side thereof 23. The first cooling air guide wall 56 at the left side is formed in such a vortex shape as to gradually get remoter from the cooling fan 6 in a direction of rotation (in this case, in a direction of counterclockwise rotation) between a first cut off point 58 located at the left and back position of the cooling fan 6 and the front side of thereof 6. And the second cooling air guide wall 57 at the right side is formed in such a vortex shape as to gradually get remoter therefrom 6 in a direction of rotation between a second cut off point 59 located at the right and front position of the cooling fan 6 and the right and back side thereof 6.

Between the second cooling air guide wall 57 at the right side and the front wall of the upper side cover section 42, there is provided the exhaust air outlet passage 51 extending horizontally. And the outlet 53 thereof 51 is opened at the right and front position of the upper side cover section 42. And inside of the second cooling air guide wall 57, there is provided the exhaust air conduction passage 52 extending horizontally from the fan room 3. The outlet 54 of the exhaust air conduction passage 52 is provided in the lower wall portion 22 of the fan case 20 and is in communication with the inlet 35*a* of the muffler cooling air passage 35 of the muffler unit 32 through an exhaust air duct 61.

And for further guiding smoothly to the outlet 54 of the exhaust air conduction passage 52 a cooling air guided thereby 52, a guide plate 63 for changing the flow direction of the exhaust air is provided at the upper side of the exhaust air conduction passage 52 inside thereof 52 as shown in FIG. 1. The guide plate 63 is fixedly secured to the upper wall portion 21 of the fan case 20 and has such a shape that its area projected in a plan view gets larger in a direction of getting near to the lower wall portion 22 of the fan case 20 along the flow direction of the exhaust air.

And as shown in FIG. 1, in the fan room 3 of the fan case 20, there is provided a recoil starter 65 coaxially with the cooling fan 6 thereabove 6. A mounting plate 66 for the starter 65 and a guide plate 67 protruded from the periphery of the mounting plate 66 compose the upper wall portion 21 of the fan case 20. A starter handle 68 for the recoil starter 65 is provided in the upper side cover section 42 in a projecting manner (refer to FIG. 2). And between the upper wall portion 21 of the fan case 20 and the upper side cover section 42, there is provided an upper ventilation room 48 which is in communication with the upper portion of the machine room 2 through a plurality of vent openings 69. These vent openings 69 are provided in the upper portion of the right and left cooling air guide walls 56, 57 at a predetermined separation distance in their peripheral directions. And the upper ventilation room 48 and the fan room 3 are in communication with each other through an auxiliary air suction opening 49.

The cooling fan 6 is of a type having upper and lower suction portions and equipped with a rotation plate 71 to be connected to the generator 5, a lower side fan 72 provided on the lower surface of the rotation plate 71 and an upper side fan 73 provided on the upper surface thereof 71. The lower side fan 72 serves to suck the air from the machine room 2 into the fan room 3 through the air suction opening 46. And the upper side fan 73 serves to suck the air within the upper space of the machine room 2 through the vent opening 69, the upper ventilation room 48 and the auxiliary air suction opening 49.

Then the assembly procedure of the soundproof cover 1 will be explained mainly with reference to FIG. 6 hereinafter. That is, the left and right air guide walls 56, 57 of the upper side cover section 42 are placed on the lower wall portion 22 of the fan case 20, and four bolts (fixing means) 75 vertically inserted through the upper side cover section 42 are threadably engaged with the lower wall portion 22 of the fan case 20 so that the upper side cover section 42 can be fixedly secured to the engine 4 through the cooling air guide cover 15 for the generator 5 and the cooling air guide cover 14 for the engine 4. And the front side cover section 43 is fixedly secured at its upper left and right locations to the front portion of the upper side cover section 42 by means of two through-bolts (fixing means) 76 and at its lower central locations to the base 77 of the engine 4 by means of a bolt 78. And similarly the back side cover section 44 is fixedly secured at its upper left and right locations to the back side of the upper side cover section 42 by means of a two through-bolts 79 and at its lower central location to the base 77 of the engine 4 through a bracket 80 by means of a bolt 81 (refer to FIG. 4). Further, the back side cover section 44 is fixedly secured at its opposite sides to the front side cover section 43 by means of four through-bolts (fixing means) 82.

Figure 3:
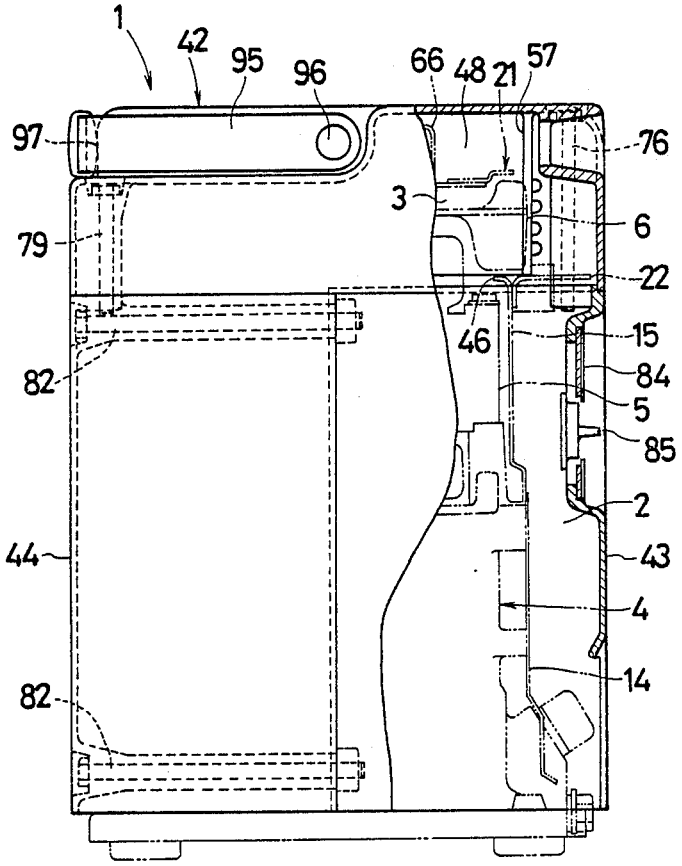

By the way, in order to prevent a noise from leaking through the abutments between the front side cover section 43 and the upper side cover 42 and between it 43 and the back side cover section 44 and to facilitate the positioning of the front side cover section 43, the upper end surface as well as the left and right back end surfaces of the front side cover section 43 are provided with stepped shoulders so that the abutments are overlapped from inside (refer to FIG. 3 and FIG. 4).

Now, as shown in FIG. 2 and FIG. 3, an operation panel 84 is arranged at the upper side of the front side cover section 43. The operation panel 84 is provided with following component parts. That is, there are provided the fuel cock 28, an operation dial 85 for a choke valve (not illustrated), an operation switch 86 for starting and stopping the engine 4, a direct current plug socket 87 for battery charging, an alternating current plug socket 88, circuit breakers 89, 90 for an alternating current output circuit and for a general direct current output circuit, an earth terminal 91, a pilot lamp 92 and an alarm lamp 93 for a shortage of oil. And in order to simplify a working for mounting and dismounting the front side cover section 43, these component parts 28, 85 through 93 are not directly attached onto the operation panel 84 but attached onto a supporting plate (not illustrated) which is provided at the back side of the operation panel 84 and supported by the engine 4. The operation panel 84 is provided with openings for receiving or fitting those component parts 28, 85 through 93.

Further as shown in FIG. 2 and FIG. 4 the base 77 of the engine 4 is provided at its front side with a feed cap 94 for supplying lubricating oil to an oil pan within the base 77. In order to facilitate the manipulation of the feed cap 94 as well as the oil supply, the front side cover section 43 is provided at its lower portion with an inverted U-shaped cutout portion 43*a*, of which upper peripheral surface is inclined inwardly downwardly. And a drain plug 99 is provided in the base 77 at its front side below the feed cap 94.

And as shown in FIG. 1 and FIG. 3, a handy handle 95 for carrying the engine generator is attached vertically swingably to the opposite side walls of the upper side cover section 42 by means of pivot pins 96, 96. That is, there is provided a concaved portion 97 for accommodating the handy handle 95 at the upper portion of the back wall as well as the opposite walls of the upper side cover section 42. The handy handle 95 is vertically swingably attached at its opposite ends to the opposite side walls of the upper side cover section 42 by means of pivot pins 96, 96. And when carrying the engine generator, the handy handle 95 is turned to its upright position, namely to its usably position in which it projects upwardly from the concaved portion 97. To the contrary, when operating the engine generator, the handy handle 95 is turned to its horizontal position, namely to its unusable position in which it is retracted into the concaved portion 97. By the way, the handy handle 95 and the concaved portion 97 may be provided at the center side of the upper side cover section 42.

In the engine generator as constructed above, when the cooling fan 6 is driven by the engine 4, the air within the soundproof cover 1 is adapted to be sucked into the fan room 3 through the air suction opening 46 after cooling the engine 4 and the generator 5 while passing through the cooling air guide cover 14 for the engine 4 and the cooling air guide cover 15 for the generator 5 as shown by a solid directed line in FIG. 1. And on the other hand, the air within the soundproof cover 1 is adapted to be sucked into the fan room 3 from the upper space of the machine room 2 through the vent opening 69, the upper ventilation room 48 and the auxiliary air suction opening 49 after cooling a fuel tank 27, the intake device, an exhaust device, the ignition system and the operation panel 84 which are all arranged outside the cooling air guide covers 14, 15. Since the air is adapted to be sucked from the upper space of the machine room 2 to the fan room 3 in that way, a hot air is prevented from stagnating in the upper space of the machine room 2.

The air sucked into the fan room 3 is discharged outside the fan room 3 by means of the cooling fan 6. Thereupon, as shown in FIG. 5, the air discharged by means of the cooling fan 6 between the first cut off point 58 and the second cut off point 59 is discharged directly outside the soundproof cover 1 through the exhaust air outlet passage 51. And the air discharged by means of the cooling fan 6 between the second cut off point 59 and the first cut off point 58 is supplied to the muffler cooling air passage 35 through the exhaust air conduction passage 52.

By the way, as shown in FIG. 6, even though the above-mentioned embodiment employs the bolts 75, 76, 78, 79, 81, 82 by which the soundproof cover 1 is fixed, it may be possible to omit the bolts 78, 79, 81.

Figure 7:
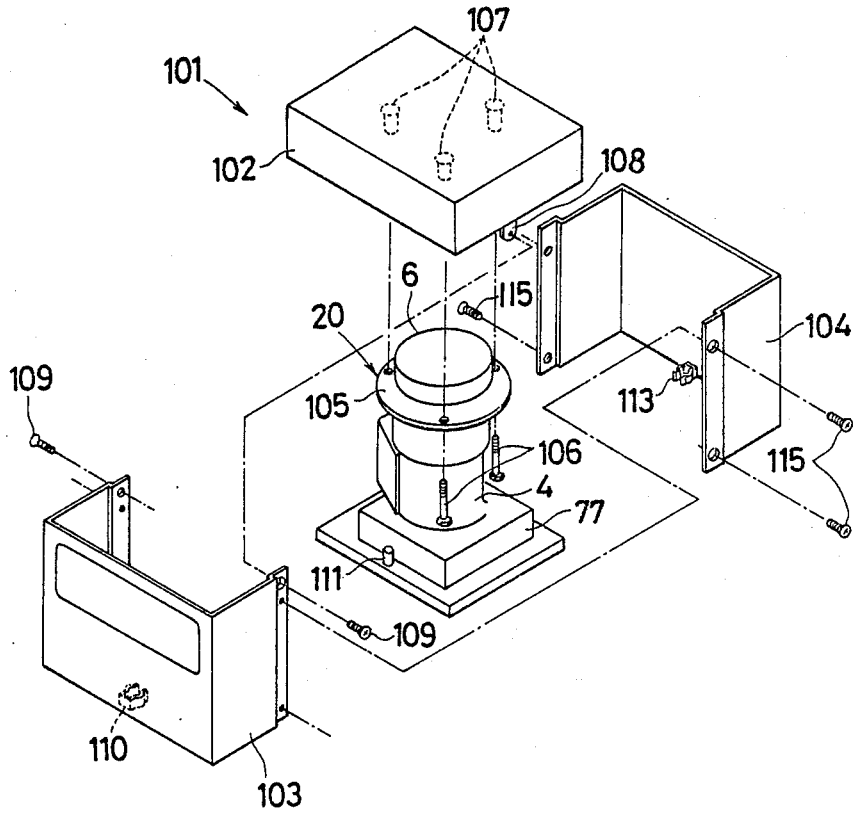

FIG. 7 shows another embodiment of the present invention.

The same as the heretofore mentioned embodiment, a soundproof cover 101 comprises an upper side cover section 102, a front side cover section 103 and a back side cover section 104.

In this case, there through-bolts (fixing means) 106 are adapted to be inserted into the lower wall portion 105 of the fan case 20 from its lower side, and bosses 107 for providing threaded holes are provided at the inside of the upper side cover section 102. And by threadably engaging the bolts 106 with the threaded holes in the bosses 107, the upper side cover section 102 is fixedly secured to the lower wall portion 105 of the fan case 20. A pair of brackets 108 are projected downwardly from the opposite sides of the upper side cover section 102. The front side cover section 103 is fixedly secured at its back and upper portions of the opposite sides to the brackets 108 by means of flat head screws 109, 109. By the way, a steady rest means 110 having a U-shaped plan view is fixedly secured to the front side cover section 103 at the lower and center portion of its front wall. The steady rest means 110 is fitted to a column fixed to the front portion of the base 77 of the engine 4 so that the steady rest for the front side cover section 103 is attained in the left and right direction as well as in the fore and rear direction. And similarly another steady rest means 113 is fixed to the back side cover section 104 at the lower and center portion of its back wall. The steady rest means 113 is fitted to a column (not illustrated) fixed to the back portion of the base 77 of the engine 4 so that the steady rest for the back side cover section 104 is attained in the left and right direction as well as in the fore and rear direction. Further, the respective side walls of the back side cover section 104 are fixedly secured to the corresponding side walls of the front side cover section 103 by means of flat head screws (fixing means) 115, 115.

By the way, in the above-mentioned embodiments, the soundproof cover 1 may be formed by means of casting of metal such as aluminum alloy, cast iron and the like instead of the injection molding of synthetic resin and may be formed by means of a squeeze process or a press process of a steel plate.

And as the engine working machine assembly, may be adopted such an assembly as to employ a compressor to be driven by the engine 4 instead of the engine generator in which the generator 5 is adapted to be driven by the engine 4.

What is claimed:

1. In an engine working machine assembly with a soundproof cover, there being provided a vertical shaft type air-cooled engine, a working machine, a cooling fan, a cooling air guide cover for the engine, a cooling air guide cover for the working machine, a fan case and a soundproof cover, said working machine and said cooling fan being arranged in series in order above said vertical shaft type engine, and these working machine and cooling fan being interlockingly connected to the engine, the outer peripheries of the cylinder and the cylinder head of said engine being enclosed with said cooling air guide cover for the engine, the outer periphery of the working machine being enclosed with said cooling air guide cover for the working machine, and the outer periphery of the cooling fan being enclosed with said fan case, the front, back, left and right sides as well as the upper side of a subassembly whose outline being defined by the engine, the cooling air guide cover for the engine, the cooling air guide cover for the working machine and the fan case being enclosed with said soundproof cover, said cooling air guide covers for the engine and the working machine being fixedly secured to the engine, and said fan case being fixedly secured at its lower wall portion to the cooling air guide cover for the working machine, the lower space within said soundproof cover being in communication with the outer space outside the soundproof cover through the inner spaces within the cooling air guide covers for the engine and for the working machine and within the fan case in order, said soundproof cover comprising an upper side cover section, a front side cover section and a back side cover section, said upper side cover section being detachably fixed to the fan case at its lower wall portion by means of fixing means, at least one of said front side cover section and said back side cover section being detachably fixed to the upper side cover section by means of fixing means, and the other cover section being detachably fixed to said one cover section by means of fixing means.

2. An engine working machine assembly with a soundproof cover as recited in claim 1, wherein said one cover section is fixedly secured to the engine.

3. An engine working machine assembly with a soundproof cover as recited in claim 1, wherein said other cover section is fixedly secured to the upper side cover section and to the engine.

4. An engine working machine assembly with a soundproof cover as recited in claim 1, wherein said one cover section and said other cover section are secured at their lower portions to the engine by means of steady rest means respectively.

5. An engine working machine assembly with a soundproof cover as recited in claim 1, wherein said upper side cover section is provided at its upper portion with a concaved portion for accommodating a handy handle for carrying the engine working machine assembly, and said handy handle is attached to the upper side cover section pivotably between the usable position in which the handy handle projects from the concaved portion and the unusable position in which it is retracted therein.

6. An engine working machine assembly with a soundproof cover as recited in claim 5, wherein said concaved portion is provided in the upper portions of the back wall and the opposite side walls of the upper side cover section.

* * * * *